US005982252A

United States Patent [19]

Werlau

[11] Patent Number: 5,982,252

[45] Date of Patent: Nov. 9, 1999

[54] HIGH POWER BROADBAND NON-DIRECTIONAL COMBINER

[75] Inventor: Bernard J. Werlau, Brewster, N.Y.

[73] Assignee: Werlatone, Inc., Brewster, N.Y.

[21] Appl. No.: 09/067,852

[22] Filed: Apr. 27, 1998

[51] Int. Cl.[6] ..... H01P 5/12

[52] U.S. Cl. ..... 333/127; 333/26

[58] Field of Search ..... 333/127, 136, 333/130, 131, 22, 26

[56] References Cited

U.S. PATENT DOCUMENTS

| | | | |
|---|---|---|---|
| 3,274,520 | 9/1966 | Eddy et al. | 333/127 |
| 4,309,666 | 1/1982 | Ito et al. | 330/286 |
| 4,647,868 | 3/1987 | Mueller | 330/286 |
| 4,774,481 | 9/1988 | Edwards et al. | 333/127 |
| 4,916,410 | 4/1990 | Littlefield | 330/295 |
| 5,021,755 | 6/1991 | Gustafson | 333/128 |
| 5,410,281 | 4/1995 | Blum | 333/127 |
| 5,424,695 | 6/1995 | Konishi | 333/131 |
| 5,668,510 | 9/1997 | Humphreys | 333/127 |

*Primary Examiner*—Robert Pascal
*Assistant Examiner*—Barbara Summons
*Attorney, Agent, or Firm*—St. Onge Steward Johnston & Reens LLC

[57] ABSTRACT

A non-directional signal combiner including a common ground plane, first and second coaxial cable connectors and a sum port. Each of the connectors has an inner conductor and an outer conductor, with the outer conductors connected to the common ground plane. The combiner also includes first and second coaxial cables, each having inner and outer conductors. The inner conductor of the first coaxial cable extends between the inner conductor of the first connector and the sum port, while the inner conductor of the second coaxial cable extends between the inner conductor of the second connector and the sum port. Each of the first and the second coaxial cables are wound into coils.

25 Claims, 5 Drawing Sheets

HIGH POWER BROADBAND NON-DIRECTIONAL COMBINER

FIELD OF THE INVENTION

The present invention relates to a signal combiner, and more particularly to a high power broadband non-directional signal combiner for use with coherent and non-coherent solid state power amplifiers.

BACKGROUND OF THE INVENTION

The development of solid-state power amplifiers for RF transmitters has created challenges to designers not present in previous tube designs. One major problem with solid-state designs is their limited power handling capability. While high power devices have been developed, they are generally quite expensive and thus are not desirable for designs where cost is a significant factor.

One strategy for solving this dilemma has been to divide the signal to be amplified into several components and direct them to a like number of smaller solid-state power amplifiers. The outputs of the power amplifiers are then combined to provide an output signal level which is comparable to or higher than the output signal which could have been obtained from a single high power solid-state power amplifier.

This divide-and-conquer strategy has its own drawbacks, however. The primary drawback was that previous signal dividers and combiners had used conventional wound transformers and lumped inductive and capacitive components to achieve the required impedance matching. Such components are inherently narrow-banded and are thus impractical for applications where wide bandwidths are required. Modern solid-state power amplifiers are generally broad-banded, and conventional narrow-banded signal dividers and combiners severely limited their utility.

One solution to such narrow-banded dividers and combiner was provided by U.S. Pat. No. 4,774,481 to Edwards et al., which discloses a broadband non-directional signal combiner (non-directional meaning that the combiner can be used as either a combiner or a divider). The combiner utilizes coaxial cables interconnected in a bridge configuration, and a coaxial cable transformer. The bridge configuration increases bandwidth, while the transformer counteracts the impedance transforming characteristics of the combiner. The combiner disclosed by Edwards et al. also incorporated ferrite sleeves over each coaxial cable in the combiner to eliminate even mode impedances between the cable outer conductors and the common ground plane.

The resulting combiner disclosed by Edwards et al. combines and divides signals across a broad range of frequencies with relatively large isolation between input ports, and a low voltage standing wave ratio. However, the use of ferrite sleeves introduces core losses resulting in heat dissipation and degraded intermodulation distortion performance ("IMD") at high power levels, limiting its usefulness in some applications. In addition, the combiner has a relatively large number of interconnections which act as discontinuities in the circuit, which increase insertion losses.

What is still needed, therefore, is a non-directional signal combiner having a short signal path with few discontinuities, such that insertion losses are low and relatively little inductance is required in the signal path. What is also needed is a non-directional combiner that combines and divides signals across a broad range of frequencies with large isolation between input ports and a low voltage standing wave ratio. What is further needed is a non-directional combiner that inherently exhibits excellent IMD characteristics, such that high power can be handled with little distortion. Preferably, the combiner will also have a simple design, be conducive to mass production, and be rugged and durable yet relatively inexpensive.

SUMMARY OF THE INVENTION

An object, therefore, of the present invention is to provide a non-directional signal combiner having a short signal path with few discontinuities, such that insertion losses are low and relatively little inductance is required in the signal path.

Another object of the present invention is to provide a signal combiner that combines and divides signals across a broadband of frequencies.

An additional object of the present invention is to provide a signal combiner that combines and divides signals across a broadband of frequencies with large isolation between input ports and a low voltage standing wave ratio among all ports.

A further object of the present invention is to provide a signal combiner that inherently exhibits excellent IMD characteristics, such that high power can be handled with little distortion.

Still another object of the present invention to provide a signal combiner assembly having a simple design that is conducive to mass production, and is rugged and durable yet relatively inexpensive.

These and other objects of the present invention are achieved by a signal combiner including a common ground plane, first and second coaxial cable connectors each having inner conductors and outer conductors, with the outer conductors connected to the common ground plane, and a sum port. The combiner also includes a first coaxial cable having an inner conductor and an outer conductor, with the inner conductor extending between the inner conductor of the first connector and the sum port. A second coaxial cable has an inner conductor and an outer conductor, with the inner conductor extending between the inner conductor of the second connector and the sum port. Each of the first and the second coaxial cables are wound into coils. The combiner, therefore, has a short signal path with few discontinuities, such that insertion losses are low and relatively little inductance is required in the signal path. In addition, since the combiner incorporates coils in place of ferrite sleeves, the combiner is able to handle high power with little distortion such that it exhibits excellent IMD characteristics.

According to one aspect of the present invention, the combiner also includes a third and a fourth coaxial cable. The third coaxial cable has an inner conductor and an outer conductor, with the inner conductor extending between a first end of the outer conductor of the first coaxial cable and a second end of the outer conductor of the second coaxial cable. Both ends of the outer conductor of the third coaxial cable are connected to the common ground plane. The fourth coaxial cable has an inner conductor and an outer conductor, with the inner conductor extending between a first end of the outer conductor of the second coaxial cable and a second end of the outer conductor of the first coaxial cable. Both ends of the outer conductor of the fourth coaxial cable are connected to the common ground plane. The combiner is therefore able to combine and divide signals across a broadband of frequencies.

According to an additional aspect of the present invention, the combiner also includes a first dissipater extending between the first ends of the outer conductors of the first and the second coaxial cables, and a second dissipater extending between the second ends of the outer conductors of the first and the second coaxial cables. The combiner, therefore, combines and divides signals across a broadband of frequencies, while providing large isolation between input ports and a low voltage standing wave ratio at all ports.

The present invention also provides a signal combiner assembly including a signal combiner, as described above, and a stepped microstrip transformer. The resulting signal combiner assembly, therefore, has a simple design that is conducive to mass production, is rugged and durable, and yet is relatively inexpensive.

Other objects, advantages and novel features of the invention will become apparent from the following detailed description of the invention when considered in conjunction with the accompanying drawings.

DETAILED DESCRIPTION OF THE INVENTION

Figure 1:
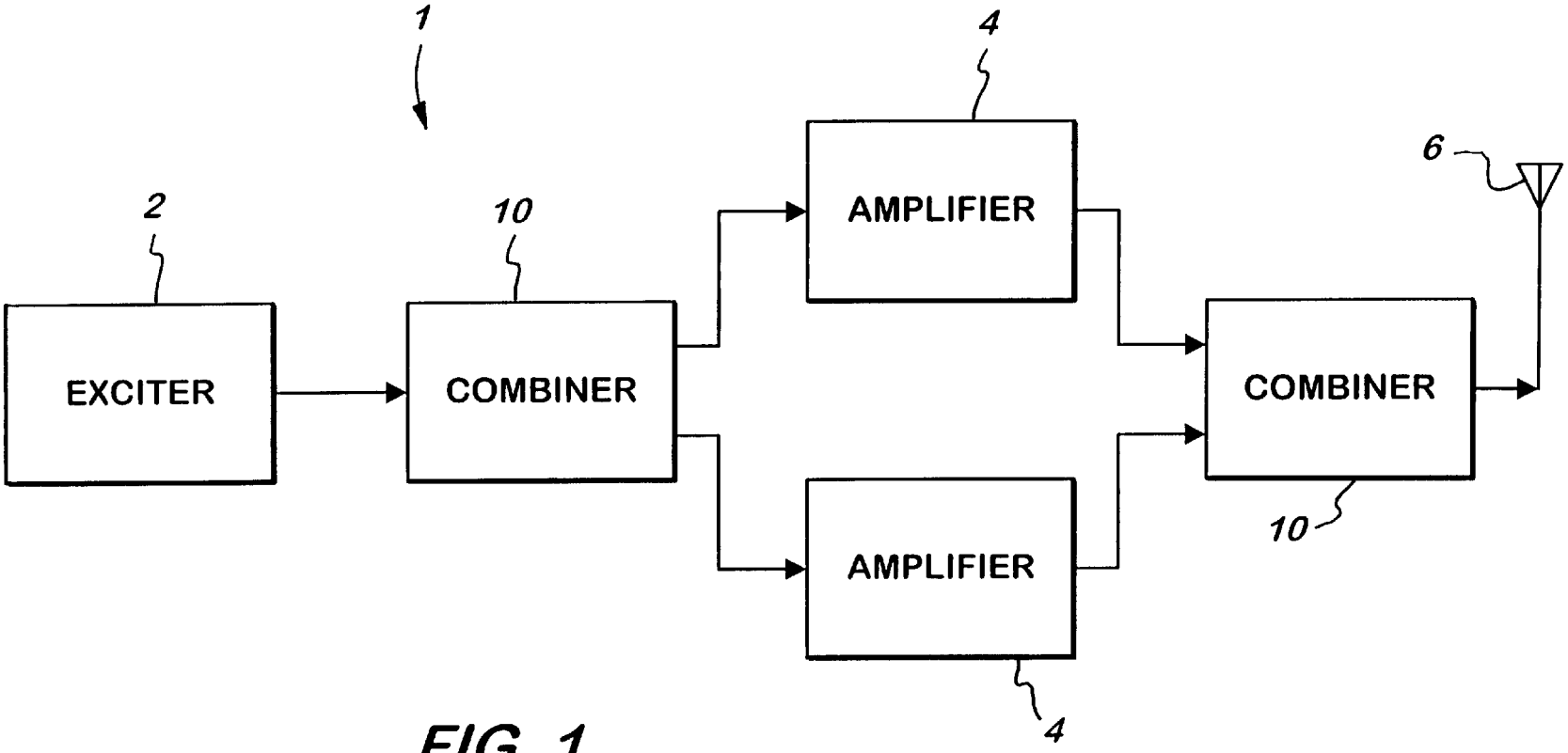
FIG. 1 is a block diagram of an radio frequency transmitter system utilizing two 2-port non-directional signal combiner assemblies according to the present invention.

Referring first to FIG. 1, a combiner assembly 10 according to the present invention may be utilized, for example, in a radio frequency transmitter system 1. The system 1 uses an exciter 2, or other device, for producing a modulated RF signal for transmission to a distant location. Exciter 2 is coupled to a first combiner assembly 10 in accordance with the present invention, which divides the signal into two components. The signal components are coupled respectively to RF power amplifiers 4, which amplify the signal components and provide the respective amplified signal components at outputs. The two amplified signal components are coupled to a second combiner assembly 10 in accordance with the present invention, which combines the two components. The amplified signal from the second combiner assembly can then be coupled to an antenna 6, or other transmission device, for transmission of the signal to a distant location.

Figure 2:
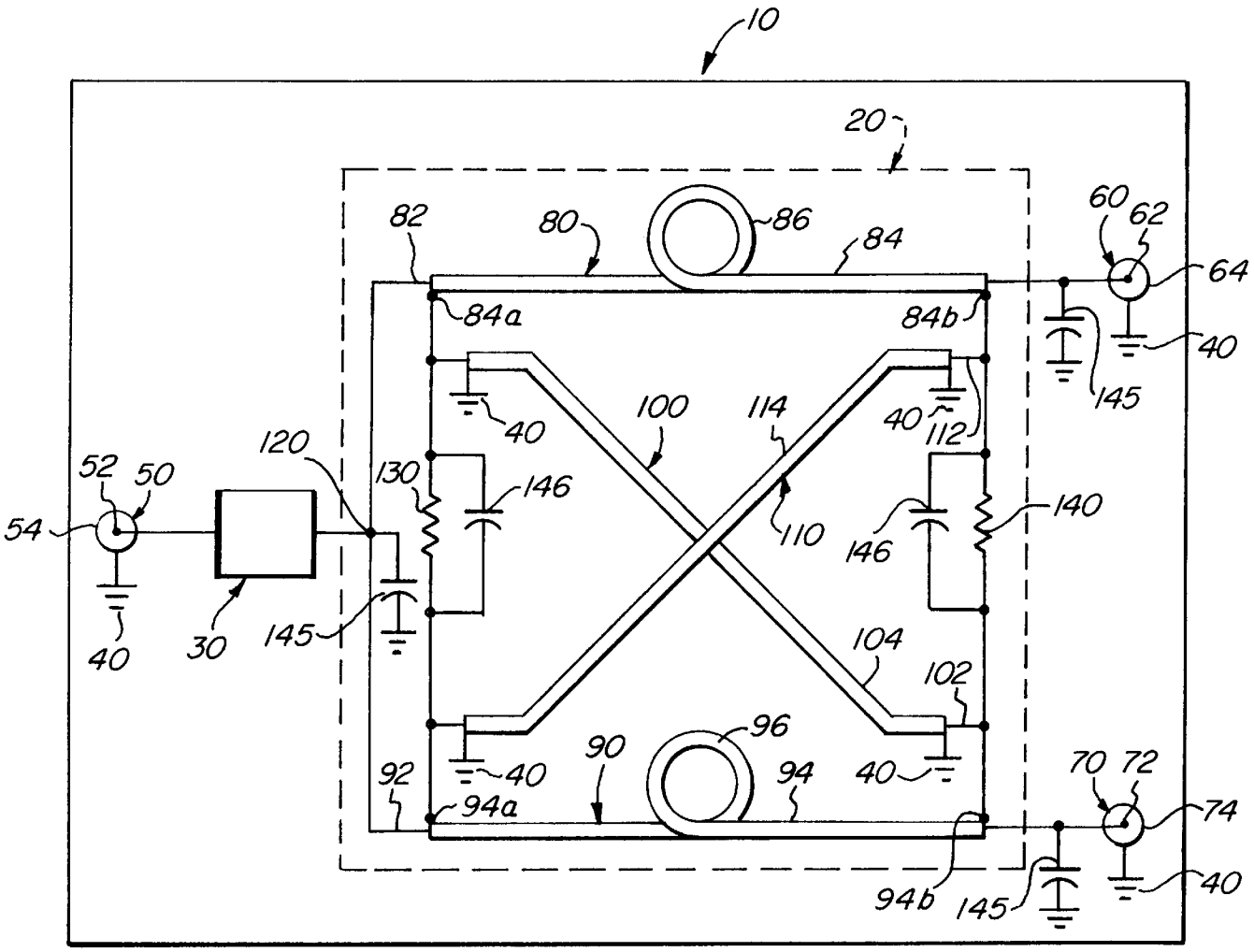
FIG. 2 is a somewhat schematic representation of the 2-port combiner assembly of FIG. 1.

Referring to FIG. 2, a somewhat schematic representation of the combiner assembly 10 of FIG. 1 is shown. It should be understood that, although the combiner assembly may function either as a combiner or divider depending upon the manner of usage, for the sake of simplicity it will be referred to as a "non-directional combiner" with the understanding that both functions are included within that term. In addition, the terms "input" and "output" are interchangeable; and when one is referred to either in the specification or the appended claims, the other is also included. Furthermore, although a 2-port non-directional combiner assembly is shown, it should be understood that a combiner assembly according to the present invention could include other appropriate numbers of input or output ports.

The combiner assembly 10 includes a non-directional combiner 20 for combining or dividing a signal, an impedance transformer 30 for counteracting the impedance reducing characteristics of the combiner, a common ground plane 40, an input port 50 and two output ports 60, 70. All of the ports 50, 60, 70 are preferably coaxial cable connectors having, respectively, inner conductors 52, 62, 72 and outer conductors 54, 64, 74 with the outer conductors connected to the common ground plane 40.

The combiner 20 includes first and second coaxial cables 80, 90 having respectively inner conductors 82, 92 and outer conductors 84, 94. The inner conductor 82 of the first coaxial cable 80 extends between a sum port 120 and the inner conductor 62 of the first output port 60, while the inner conductor 92 of the second coaxial cable 90 extends between the sum port and the inner conductor 72 of the second output port 70.

Preferably, each of the first and the second coaxial cables 80, 90 are wound respectively into coils 86, 96 of sufficient inductive reactance to minimize the effect of even mode impedances between the first and the second coaxial cables and the common ground plane. In other words, the coils 86, 96 prevent the flow of current on the surfaces of the outer conductors 84, 94 of the first and the second coaxial cables 80, 90.

Because the output ports 60, 70 are connected to the sum port 120 with 25 Ohm impedance cable, the required inductance of the first and the second coaxial cables 80, 90 is kept relatively low. Thus the first and the second coaxial cables 80, 90 can simply be wound into coils 86, 96, thereby, eliminating the need for performance-limiting ferrite sleeves on the cables, as used in prior art combiners.

The combiner 20 also includes third and fourth coaxial cables 100, 110 having respectively inner conductors 102, 112 and outer conductors 104, 114. The third and the fourth coaxial cables 100, 110 are crossed to create a bridge configuration and function as delay lines so that voltages within the combiner 20 add in phase, allowing the combiner to handle broad bandwidths. In particular, the non-directional combiner 20 according to the present invention is able to handle high power signals from high frequencies to microwave frequencies. The inner conductor 102 of the third coaxial cable 100 extends between a first end 84*a* of the outer conductor 84 of the first coaxial cable 80 and a second end 94*b* of the outer conductor 94 of the second coaxial cable 90, while the inner conductor 112 of the fourth coaxial cable 110 extends between a first end 94*a* of the outer conductor 94 of the second coaxial cable 90 and a second end 84*b* of the outer conductor 84 of the first coaxial cable 80. Both ends of the outer conductors 104, 114 of the third and the fourth coaxial cables 100, 110 are connected to the common ground plane 40.

The combiner 20 also includes first and second dissipaters 130, 140 for dissipating unbalanced input power or unbalanced loads at the ports 60, 70. The first dissipater 130 extends between the first ends 84*a*, 94*a* of the outer conductors 84, 94 of the first and the second coaxial cables 80, 90, while the second dissipater 140 extends between the second ends 84*b*, 94*b* of the outer conductors of the first and the second coaxial cables. Preferably, both of the first and the second dissipaters 130, 140 comprise isolation resistors as shown in FIG. 2.

The combiner 20 can also be provided with grounded capacitors 145 connected at the sum port 120 and at each output port 60, 70, and with capacitors 146 in parallel with the first and the second dissipaters 130, 140. The capacitors 145, 146 compensate for any residual inductive reactance within the combiner 20.

The combiner 20 provides a 1:2 impedance transformation between the sum port 120 and each output port 60, 70. In order to provide a standard 50 Ohm input impedance, the characteristic impedance of each coaxial cable 80, 90, 100, 110 is 25 Ohms, and the isolation resistors 130, 140 are each 50 Ohms. In addition, each port 50, 60, 70 has a characteristic impedance (Zo) of 50 Ohms. It is advantageous that the coaxial cables 80, 90 have characteristic impedances of 25 Ohms (Zo/2), such that the resulting inductance of the coils 86, 96 will support a lower frequency requirement. It should be understood, however, that other impedance and resistance values could be used if another input impedance is desired. The transformer 30 of the combiner assembly is accordingly provided in a 2:1 impedance transformation configuration, so that the 50 Ohm impedance of the input port 50 is transformed to a 25 Ohm impedance at the sum port 120.

Figure 3:
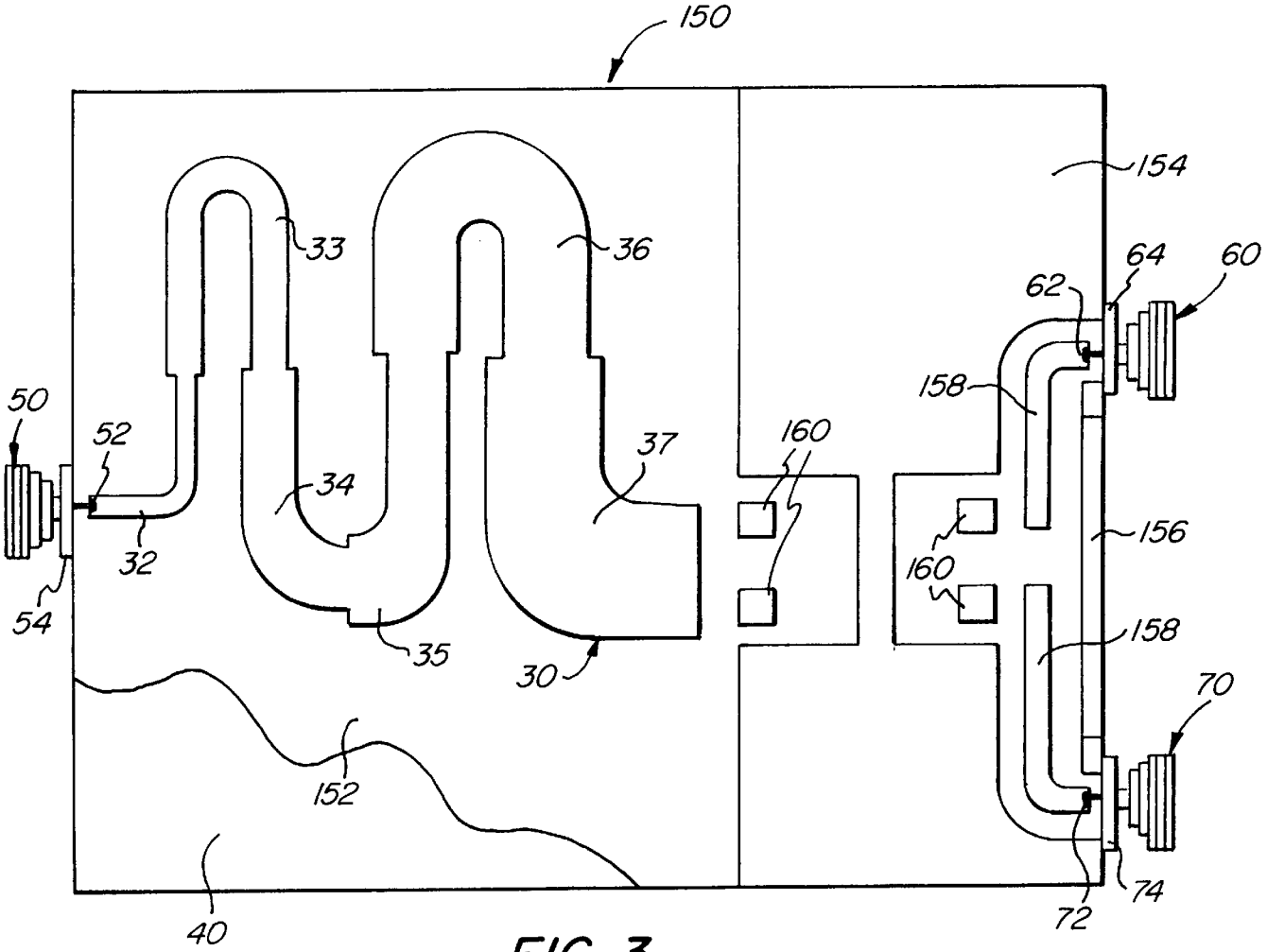
FIG. 3 is top plan view, partially cut-away, of a circuit board of the 2-port combiner assembly of FIG. 1.

Referring now to FIG. 3, the combiner assembly 10 according to the present invention preferably incorporates a circuit board 150 including the common ground plane 40 in the form of a plate of electrically conductive material, such as copper for example. The circuit board 150 also includes a layer of insulating material 152, such as Teflon® for example, over the ground plate 40. The input port 50 is mounted at one end of the board 150 with its outer conductor 54 connected to the common ground plate 40, while the output ports 60, 70 are mounted at an opposite end of the board with their outer conductors 64, 74 also connected to the common ground plate. The circuit board 152 further includes a ground surface 154 and a ground strip 156 covering a portion of the layer of insulating material 152 and connected to the common ground plate 40. Connector lines 158 and connector junctions 160 are mounted on the layer of insulating material 152, with the connector lines extending from the inner conductors 62, 72 of the output ports 60, 70. The components of the combiner 20 are mounted on the ground surface 154, the ground strip 156, the connector lines 158 and the connector junctions 160, which are made of an electrically conductive material such as copper for example.

The circuit board 150 also includes the impedance transformer 30 in the form of a stepped copper microstrip conductor extending from the inner conductor 52 of the input port 50, and electrically separated from the common ground plate 40 by the layer of insulating material 152. It should be apparent to those skilled in the art that the transformer 30 could utilize a stripline design instead of a microstrip design. In the embodiment shown, the stepped microstrip conductor 30 includes six sections, or steps, 32, 33, 34, 35, 36, 37 of substantially equal electrical length but of differing widths. As is known, the differing widths of the six sections 32, 33, 34, 35, 36, 37 provide different characteristic impedance for each section. The number of sections needed in the stepped microstrip conductor 30, and the impedance or width of each section can be calculated based upon the required input and output impedances and bandwidth of the transformer. The mathematics necessary for these calculations are known and can be found, for example, in an article authored by S. B. Cohn entitled "Optimum Design of Stepped Transmission-Coaxial cable Transformers," IRE Trans. on Microwave Theory and Techniques, vol. MTT-3, pp. 16–21, Apr. 1955, which is incorporated herein by reference. As shown, the stepped microstrip conductor 30 is preferably arranged on the circuit board 150 in a sinuous pattern to reduce the necessary size of the circuit board.

The combiner assembly 10 according to the present invention, having main lines 80, 90 with single coils 86, 96 of only about 0.5 inches each, surprisingly has been found to provide a frequency range of, for example, 100 MHz to 500 MHz or 200 MHz to 1,000 MHz: a 5:1 bandwidth. The combiner assembly 10 can also handle power up to 2,000 watts with linear performance and without distortion. A combiner incorporating ferrite, in contrast, exhibits core losses resulting in heat dissipation and degraded internodulation distortion performance ("IMD") at such high power levels.

The combiner assembly 10 also performed at a typical insertion loss of less than 0.3 dB, an isolation between ports 60, 70 of greater than 20 dB, and a voltage standing wave ratio at all ports 50, 60, 70 of less than 1.2:1. Furthermore, the combiner assembly 10 provides for the combining of in-phase inputs.

Although not shown, the non-directional combiner assembly 10 according to the present invention also includes a protective case. The protective case encloses the circuit board 150 and the combiner 20, yet allows access to the ports 50, 60, 70 for connection to signal amplifiers for example.

Figure 4:
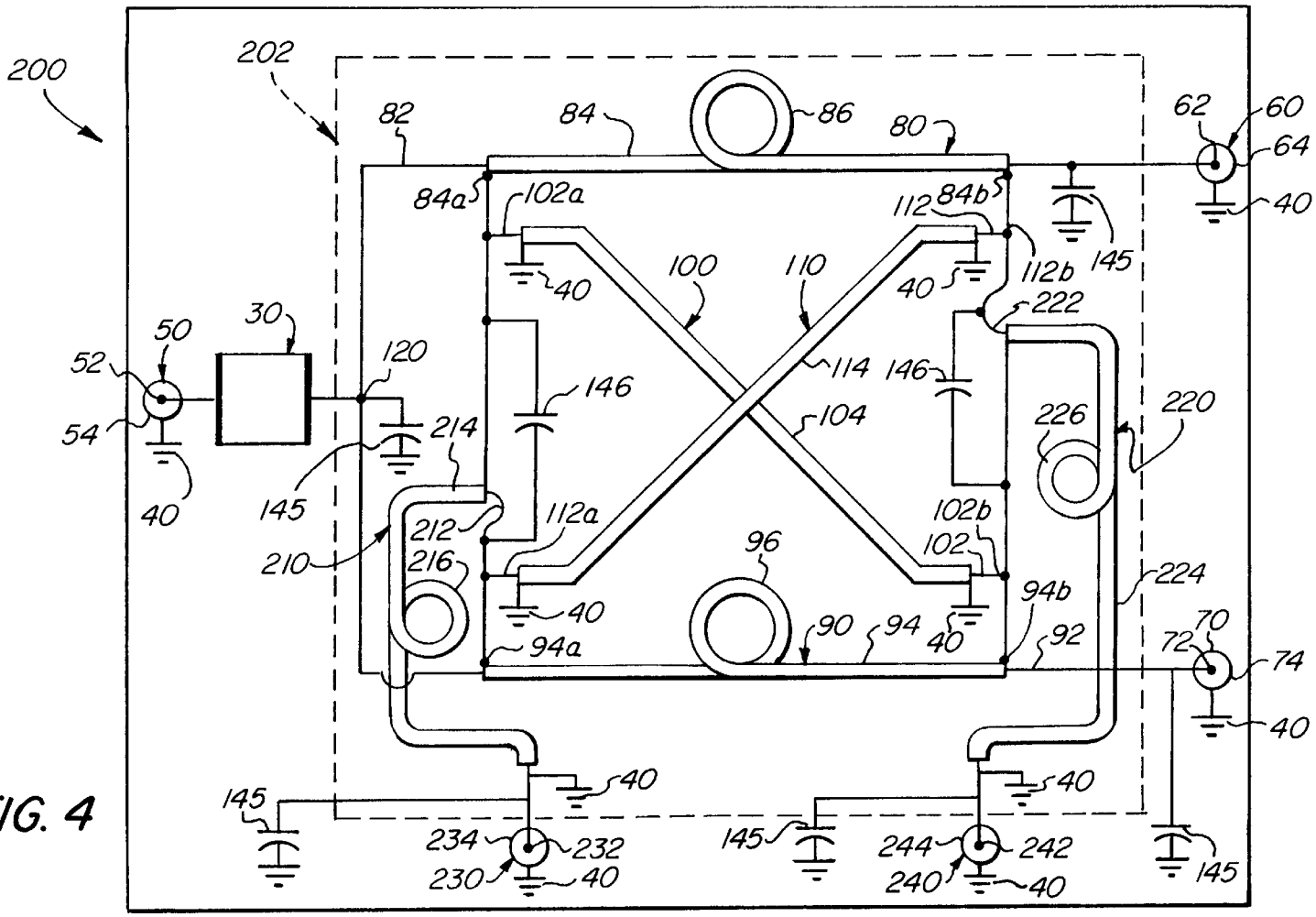
FIG. 4 is a somewhat schematic representation of another 2-port combiner assembly according to the present invention.

Referring to FIG. 4, another 2-port non-directional combiner assembly 200 according to the present invention is shown. This combiner assembly 200 is similar to the combiner assembly 10 of FIGS. 1–3, and elements that are the same have the same reference numerals. In place of the isolation resistors 130, 140, the combiner assembly 200 includes a non-directional combiner 202 having first and second dissipaters comprising baluns 210, 220. As shown, the baluns 210, 220 each extend to a port 230, 240, so that separate, or remote isolating, terminations can be connected to the combiner assembly 200. The baluns 210, 220 and remote terminations are capable of dissipating a major portion of power input to the combiner assembly 200, which is advantageous in certain applications such as when combining non-coherent high power signals. The ports 230, 240 are preferably coaxial connectors. Alternatively, each balun 210, 220 could extend to its own termination resistor connected to the common ground plane 40 for dissipating excess or unbalanced power.

The baluns 210, 220 preferably comprise coaxial cables having a characteristic impedance of 50 Ohms each. An inner conductor 212 of the first balun 210 is connected to the first end 94*a* of the outer conductor 94 of the second coaxial cable 90 and a first end 112*a* of the inner conductor 112 of the fourth coaxial cable 110, and extends to an inner conductor 232 of the port 230. An outer conductor 214 of the first balun 210 is connected at one end to the first end 84*a* of the outer conductor 84 of the first coaxial cable 80 and a first end 102*a* of the inner conductor 102 of the third coaxial cable 100, and connected at an opposite end to the common ground plane 40. An inner conductor 222 of the second balun 220 is connected to the second end 84*b* of the outer conductor 84 the first coaxial cable 80 and a second end 112*b* of the inner conductor 112 of the fourth coaxial cable 110, and extends to an inner conductor 242 of the port 240. An outer conductor 224 of the second balun 220 is connected at one end to the second end 94*b* of the outer conductor 94 of the second coaxial cable 90 and a second end 102*b* of the inner conductor 102 of the third coaxial cable 100, and connected at an opposite end to the common ground plane 40.

As shown, the baluns 210, 220 are preferably wound respectively into coils 216, 226 of sufficient inductive reactance to minimize the effect of even mode impedance between the baluns and the common ground plane 40. In other words, the coils 216, 226 prevent the flow of current on the surface of the outer conductors 212, 222 of the baluns 210, 220. Winding the baluns 210, 220, therefore, eliminates the need for ferrite sleeves over the baluns. It should be noted that while coaxial baluns 210, 220 are preferred, the baluns can alternatively be provided in the form of a stripline, a microstrip, or a transformer type.

Figure 5:
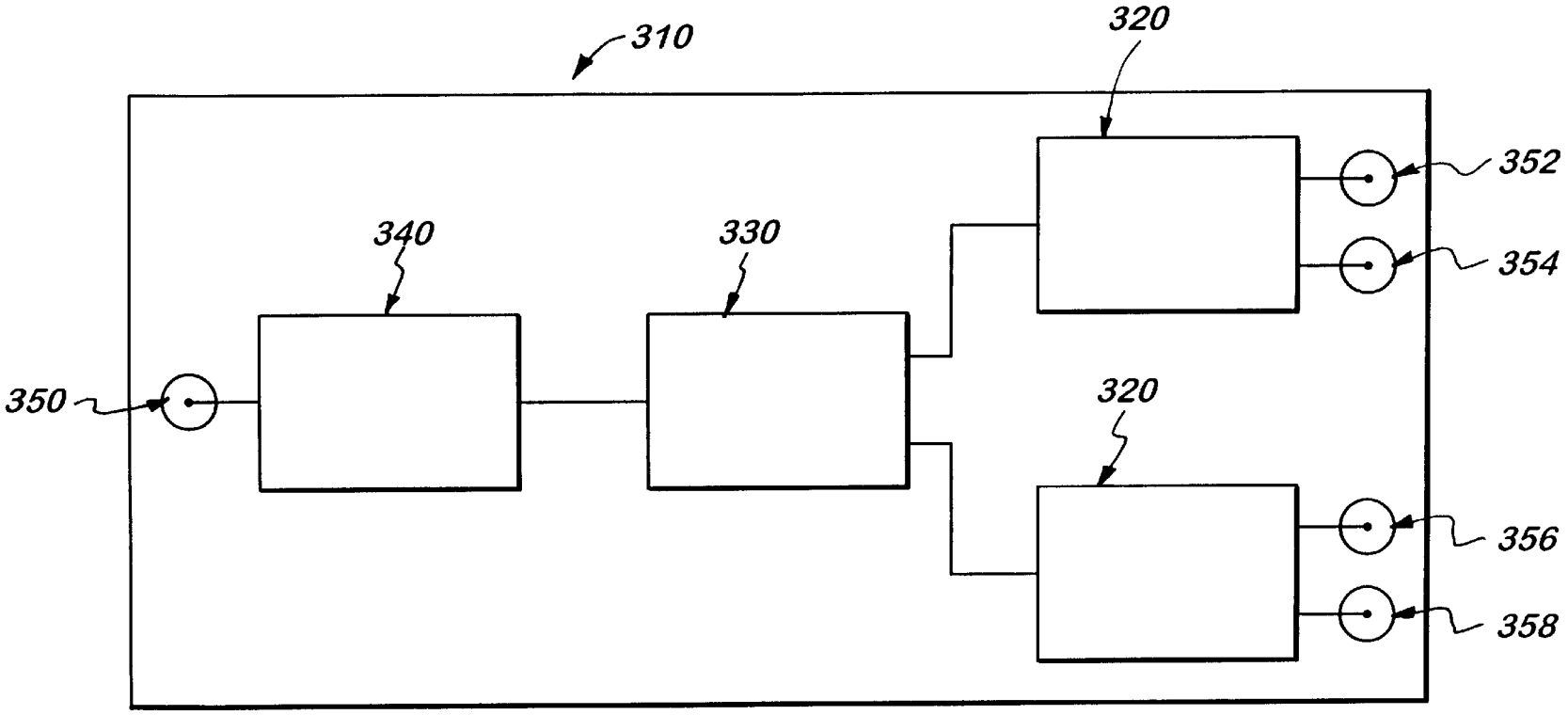
FIG. 5 is a block diagram of a 4-port combiner assembly according to the present invention.

A 4-port non-directional combiner assembly 310 according to the present invention is shown in FIG. 5, and includes two 2-port combiners 320 of the type shown in FIG. 2, cascaded with a third 2-port combiner 330, and a 4:1 impedance transformer 340. One of the combiners 320 is connected to ports 352, 354, while the other combiner 320 is connected to ports 356, 358, and the transformer 340 is connected to port 350. The third combiner 330 is identical to the combiner 20 shown in FIG. 2, except that it uses 12.5 Ohm characteristic impedance coaxial cables and 25 Ohm isolating resistors. This is necessary to match the 25 Ohm output impedance of the combiners 320. Otherwise all components are identical to those in FIG. 2. In addition, one or all of the combiners 320, 330 of the 4-port combiner 310 may include baluns in place of the isolating resistors similar to the combiner of FIG. 4.

Although not shown, the 4-port combiner assembly 310 includes a circuit board similar to the circuit board 150 of the 2-port combiner assembly 10 of FIGS. 1–3, yet is necessarily larger to hold the three combiners 320, 330 and 1:4 transformer 340. Since the 2:1 impedance step-down of the combiners 320, 330 results in a 12.5 Ohm output impedance, a 1:4 impedance step-up is required in the transformer 340. Preferably, the transformer 340 comprises a stepped copper microstrip conductor formed as part of the circuit board of the 4-port combiner assembly 310. As an example, the stepped microstrip conductor includes eight sections, or steps, of substantially equal electrical length but of differing widths, or characteristic impedance. The number of sections needed in the stepped microstrip conductor, and the impedance or width of each section, as discussed above, can be calculated based upon the required input and output impedances and bandwidth of the transformer.

Although the invention has been described with reference to a particular arrangement of parts, features and the like, these are not intended to exhaust all possible arrangements or features, and indeed, many other modifications and variations will be ascertainable to those skilled in the art.

What is claimed is:

1. A signal combiner comprising:

a common ground plane;

first and second coaxial cable connectors each having inner conductors and outer conductors, with the outer conductors connected to the common ground plane;

a sum port;

a first coaxial cable having an inner conductor and an outer conductor, with said inner conductor extending between the inner conductor of the first connector and the sum port;

a second coaxial cable having an inner conductor and an outer conductor, with said inner conductor extending between the inner conductor of the second connector and the sum port;

a third coaxial cable having an inner conductor and an outer conductor, with said inner conductor extending between a first end of the outer conductor of the first coaxial cable and a second end of the outer conductor of the second coaxial cable, with both ends of said outer conductor of said third coaxial cable connected to the common ground plane; and a fourth coaxial cable having an inner conductor and an outer conductor, with said inner conductor extending between a first end of the outer conductor of the second coaxial cable and a second end of the outer conductor of the first coaxial cable, with both ends of said outer conductor of said fourth coaxial cable connected to the common ground plane.

2. A signal combiner according to claim 1 wherein each of the first and the second coaxial cables are wound into coils.

3. A signal combiner according to claim 1 wherein each of the first, second, third and fourth coaxial cables has an impedance equal to half a characteristic impedance of the combiner.

4. A signal combiner according to claim 1 further comprising:

a first dissipater extending between the first ends of the outer conductors of the first and the second coaxial cables; and a second dissipater extending between the second ends of the outer conductors of the first and the second coaxial cables.

5. A signal combiner according to claim 4 wherein each of the first and the second dissipaters comprises a resistor.

6. A signal combiner according to claim 4 wherein the first dissipater comprises a balun extending to a resistor connected to the common ground plane, and the second dissipater comprises a balun extending to a resistor connected to a common ground plane.

7. A signal combiner according to claim 4 wherein the first dissipater comprises a balun extending to a port and the second dissipater comprises a balun extending to a port.

8. A signal combiner according to claim 4 wherein each of the first and the second dissipators has a resistance equal to a characteristic impedance of the combiner.

9. A signal combiner comprising:

a common ground plane;

first and second coaxial cable connectors each having inner conductors and outer conductors, with the outer conductors connected to the common ground plane;

a sum port;

a first coaxial cable having an inner conductor and an outer conductor, with said inner conductor extending between the inner conductor of the first connector and the sum port;

a second coaxial cable having an inner conductor and an outer conductor, with said inner conductor extending between the inner conductor of the second connector and the sum port; and wherein each of the first and the second coaxial cables are wound into coils.

10. A signal combiner according to claim 9 further comprising:

a third coaxial cable having an inner conductor and an outer conductor, with said inner conductor extending between a first end of the outer conductor of the first coaxial cable and a second end of the outer conductor of the second coaxial cable, with both ends of said outer conductor of said third coaxial cable connected to the common ground plane; and a fourth coaxial cable having an inner conductor and an outer conductor, with said inner conductor extending between a first end of the outer conductor of the second coaxial cable and a second end of the outer conductor of the first coaxial cable, with both ends of said outer conductor of said fourth coaxial cable connected to the common ground plane.

11. A signal combiner according to claim 10 wherein each of the first, second, third and fourth coaxial cables has an impedance equal to half a characteristic impedance of the combiner.

12. A signal combiner according to claim 9 further comprising:

a first dissipater extending between the first ends of the outer conductors of the first and the second coaxial cables; and a second dissipater extending between the second ends of the outer conductors of the first and the second coaxial cables.

13. A signal combiner according to claim 12 wherein each of the first and the second dissipaters comprise a resistor.

14. A signal combiner according to claim 12 wherein the first dissipater comprises a balun extending to a resistor connected to the common ground plane, and the second dissipater comprises a balun extending to a resistor connected to a common ground plane.

15. A signal combiner according to claim 12 wherein the first dissipater comprises a balun extending to a port and the second dissipater comprises a balun extending to a port.

16. A signal combiner according to claim 12 wherein each of the first and the second dissipators has a resistance equal to a characteristic impedance of the combiner.

17. A signal combiner assembly comprising:

a common ground plane;

first, second and third coaxial cable connectors each having inner conductors and outer conductors, with the outer conductors connected to the common ground plane;

an impedance transformer connected to the inner conductor of the third connector; and a signal combiner including, a first coaxial cable having an inner conductor and an outer conductor, with said inner conductor extending between the inner conductor of the first connector and the transformer, a second coaxial cable having an inner conductor and an outer conductor, with said inner conductor extending between the inner conductor of the second connector and the transformer, and wherein each of the first and the second coaxial cables of the signal combiner are wound into coils.

18. A signal combiner assembly according to claim 17 wherein the signal combiner further comprises:

a third coaxial cable having an inner conductor and an outer conductor, with said inner conductor extending between a first end of the outer conductor of the first coaxial cable and a second end of the outer conductor of the second coaxial cable, with both ends of said outer conductor of said third coaxial cable connected to the common ground plane; and a fourth coaxial cable having an inner conductor and an outer conductor, with said inner conductor extending between a first end of the outer conductor of the second coaxial cable and a second end of the outer conductor of the first coaxial cable, with both ends of said outer conductor of said fourth coaxial cable connected to the common ground plane.

19. A signal combiner assembly according to claim 18 wherein each of the first, second, third and fourth coaxial cables of the signal combiner has an impedance equal to half a characteristic impedance of the signal combiner.

20. A signal combiner assembly according to claim 17 wherein the signal combiner further comprises:

a first dissipater extending between the first ends of the outer conductors of the first and the second coaxial cables; and a second dissipater extending between the second ends of the outer conductors of the first and the second coaxial cables.

21. A signal combiner assembly according to claim 20 wherein each of the first and the second dissipators of the signal combiner has a resistance equal to a characteristic impedance of the signal combiner.

22. A signal combiner assembly according to claim 20 wherein each of the first and the second dissipaters of the signal combiner comprises a resistor.

23. A signal combiner assembly according to claim 20 wherein the first dissipater of the signal combiner comprises a balun extending to a resistor connected to the common ground plane, and the second dissipater of the signal combiner comprises a balun extending to a resistor connected to a common ground plane.

24. A signal combiner assembly according to claim 20 wherein the first dissipater of the signal combiner comprises a balun extending to a port and the second dissipater of the signal combiner comprises a balun extending to a port.

25. A signal combiner assembly according to claim 17 wherein the transformer comprises a stepped microstrip conductor.

* * * * *